US006881302B2

(12) United States Patent
Masuda et al.

(10) Patent No.: US 6,881,302 B2
(45) Date of Patent: Apr. 19, 2005

(54) FORMER FOR USE IN PAPER PRODUCTION

(75) Inventors: Kazuhiko Masuda, Hiroshima-ken (JP); Hiroshi Iwata, Hiroshima-ken (JP); Masanobu Matsumoto, Hiroshima-ken (JP); Keiichi Fujiki, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/224,589

(22) Filed: Aug. 21, 2002

(65) Prior Publication Data

US 2003/0037898 A1 Feb. 27, 2003

(30) Foreign Application Priority Data

Aug. 24, 2001 (JP) ..... 2001-255221

(51) Int. Cl.[7] ..... D21F 1/00; D21F 1/66

(52) U.S. Cl. ..... 162/300; 162/301; 162/351; 162/352; 162/299

(58) Field of Search ..... 162/132, 133, 162/202, 203, 208, 211, 212, 217, 298–301, 308, 351–2, 363–4, 374

(56) References Cited

U.S. PATENT DOCUMENTS 4,425,188 A * 1/1984 Fujiwara ..... 162/300
4,623,429 A * 11/1986 Tissari ..... 162/300
4,790,909 A 12/1988 Harwood
5,507,918 A * 4/1996 Polifke et al. ..... 162/301
5,562,807 A * 10/1996 Baluha ..... 162/352
5,582,688 A * 12/1996 Bando et al. ..... 162/301
6,309,511 B1 * 10/2001 Iwata et al. ..... 162/352
6,372,091 B1 * 4/2002 Wildfong et al. ..... 162/301

FOREIGN PATENT DOCUMENTS

JP 05-071091 3/1993
WO WO 00 79041 A 12/2000

* cited by examiner

*Primary Examiner*—Steven P. Griffin
*Assistant Examiner*—Eric Hug
(74) *Attorney, Agent, or Firm*—Armstrong, Kratz, Quintos, Hanson & Brooks, LLP

(57) ABSTRACT

A paper former comprises two wires which converge for defining a paper production gap and a plurality of dewatering blades arranged in the paper production gap in a paper producing direction and brought into sliding contact with one of the two wires so that a stock is dehydrated while being conveyed in a state put in the paper production gap. Each of the plurality of dewatering blades is shaped into a convexly curved surface configuration bent along a traveling direction of the wires and equipped with a wire sliding contact surface brought into sliding contact with said wire for guiding the traveling of said wire, and grooves are made in said wire sliding contact surfaces as a moisture run-off opening for running off moisture developing through the dewatering from the wire side. This paper former thus constructed can suppress the occurrence of paper defects stemming from the landing of a material jet or paper defects stemming from the dewatering property, thus improving the paper quality.

12 Claims, 7 Drawing Sheets

FORMER FOR USE IN PAPER PRODUCTION

BACKGROUND OF THE INVENTION

1) Field of the Invention

The present invention relates to a forming part of paper making machine, including a twin-wire former, an on-top former and a multilayer former, which is designed to let a stock (material liquid of paper) run through a paper production gap defined between two wires while drying it.

2) Description of the Related Art

A twin-wire former has been known as one of sheet forming apparatus for use in paper machines. This twin-wire former is equipped with two mesh-like wires each shaped into a loop configuration. While a stock travels between these two wires in a state put there between, various types of drainage equipments (extractors) remove the moisture from the stock, thereby gradually forming a fibrous mat, which grows into a web.

For example, FIG. 6 illustratively shows a construction of one example of a twin-wire former. With reference to this illustration, a description will be given here in below of a twin-wire former.

As FIG. 6 shows, a stock 2 from the lip of a head box 1 is jetted toward a gap (paper production gap) 15 (see FIG. 7) defined between two mesh-like wires of a first wire (#1 wire) 3 and a second wire (#2 wire) 4.

The first wire 3 is guided by a forming roll 16, a guide roll 18 and others while the second wire 4 is guided by a breast roll 17, guide rolls 19A to 19C and others, with these wires 3 and 4 being situated to define the gap 15 there between. The stock 2 grows into a fibrous mat while traveling in this gap 15.

That is, the upper and lower wires 3 and 4 are rotationally driven to convey the stock 2 in the gap 15 in a predetermined direction (upwardly in FIG. 6), and the stock 2 travels in the gap 15 at a speed approximately equal to those of the wires 3 and 4. The gap 15 is gradually made narrower toward the downstream side in the traveling direction, and the loop of each of the wires 3 and 4 at the upstream section of the gap 15 is placed on a curved surface with a radius of curvature R. Moreover, a first drainage equipment 5, a second drainage equipment 6 and a third drainage equipment 7 are provided in the order at the upstream section of the gap 15, while a suction couch roll 8 and others are located on the downstream side of these drainage equipments.

The first drainage equipment 5 is put in the loop of the second wire 4 which has a radius of curvature R. As FIG. 7 shows, in this first drainage equipment 5, a plurality of dewatering blades 20*a* to 20*e* (which will be designated at numeral 20 if they are not required to be distinguished from each other) are spaced from each other, and the bottom wire 4 is brought into sliding contact with the top surface (front surface) of each of the dewatering blades 20 to travel to draw a loop with a radius of curvature of R, while the top wire 3 also travels along a loop having a radius of curvature of approximately R in a state in which the stock 2 is put therebetween.

While the stock 2 travels along the curved gap approximate to the radius of curvature R, it grows gradually into a fibrous mat in the gap 15 due to the drainage (see arrows headed "white water" in FIG. 8) to both sides (upper and lower wires 3, 4 sides) by the dewatering pressures stemming from the bending along the radii of curvature of the top wire 3 and the bottom wire 4 on the dewatering blades 20. Incidentally, although being fixedly secured through key slots, made in their rear surfaces, to a proximal portion of the first drainage equipment 5, each of the dewatering blades 20*a* to 20*e* is made to be attachable/detachable thereto/therefrom in the wire width (cross) directions to be individually replaceable according to paper production conditions or the like.

The second drainage equipment 6 is placed within the loop of the first wire 3 which has a radius of curvature of R, and although not shown in detail, it is equipped with a plurality of inhibited dewatering blades which control the drainage toward the first wire 3 side but allows the drainage toward only the second wire 4 side, thus forming a web gradually.

The third drainage equipment 7 is equally called "suction box", and is located within the loop of the second wire 3. Through the use of the third drainage equipment 7 and the suction couch roll 8, the drainage is made by means of vacuum, and a web formed through a transfer box (not shown) is transferred onto the second wire 4 and conveyed through a suction pickup roll (not shown) to the next press part.

In addition, a paper layer forming apparatus for a paper machine further includes, for example, an on-top former and a multilayer former. The on-top former or the multilayer former is equipped with a bottom wire extending throughout the upstream and downstream of the former and partially equipped with a top wire located at an intermediate section of the former. In this section, as well as a twin-wire former, the bottom wire and the top wire converge (are brought closer to each other) to define a paper production gap.

For example, FIG. 9 is a side elevational view illustratively showing an intermediate section of a multilayer former. As FIG. 9 shows, a stock is injected from a head box (for example, a first head box; not shown) located on the upstream side of the to form a layer (for example, a first layer) 2A and a stock is injected from a head box (for example, a second head box) 1B to form a layer (for example, a second layer) 2B in piles on the layer 2A, and after running through a paper production gap defined between a bottom wire 3 and a top wire 4, these layers 2A and 2B are formed into a multilayered web. In this illustration, only two layers are shown, but sometimes further layers are formed thereon by further injection of stocks.

In this connection, drainage equipments 5', 6' and 7' are placed at a landing position of the stock, the top wire 4 position and a downstream side position thereof, respectively. Moreover, the top wire 4 are guided by guide rolls 8' and 9'.

Also in the case of an on-top former, as well as the multilayer former shown in FIG. 9, a top wire 4 is placed at an intermediate section, but the second head box 1B is not put to use in this case, so the stock grows into a single layer.

Meanwhile, in the case of a twin-wire former, a jetted stock (which will hereinafter be referred to equally as a "material jet") 2 injected from a head box 1 is directed at a gap 15 between both wires 3 and 4, and in detail, as FIG. 8 shows, it lands in the vicinity of an upstream end of a first drainage equipment 5 and in the vicinity of a portion at which both the wires 3 and 4 converge.

That is, both the wires 3 and 4 are made to approach each other at an upstream end of a dewatering blade (which is called a "lead-in blade") 20*a* lying on the most upstream portion of the first drainage equipment 5 so that the gap 15 therebetween reaches a predetermined distance. The material jet 2 is injected to be directed at the place where both the wires 3 and 4 are brought closer to each other; in consequence, for example, the material jet 2 arrives at a landing point 10 on the first wire 3 while arriving at a landing point 11 on the second wire 4.

As FIG. 8 shows, the landing point 11 on the second wire 4 is positioned on the upstream side of the lead-in blade 20*a*. This is because, since the lead-in blade 20*a* has a solid construction (having no opening), the arrival of the material jet 2 on a surface of the lead-in blade 20*a* makes it difficult to remove an air layer incident to a plane of the material jet 2 and this air layer disturbs the material jet 2 to hinder the formation of a paper layer so that the paper production becomes unfeasible.

For this reason, the landing point 11 on the second wire 4 is set on the upstream side of the lead-in blade 20*a,* and in a case in which the material jet 2 lands on the wire at a portion of the traveling wire, particularly, where a guide, such as a blade, does not exist on the rear surface side thereof, if an angle $\beta_0$ made between the material jet 2 and the wire (in this case, the second wire 4) is made large, the reactive force against the landing of the material jet 2 increases to cause the deflection of the wire; as a result, for example, the disturbance occurs in the flow of the opposite plane of the material jet 2, that is, the wire 3 side material jet plane, to obstruct the formation of the paper layer. Accordingly, it is impossible to set the angle $\beta_0$ between the material jet 2 and the wire to a large value.

In consequence, the convergent angle between both the wires 3 and 4 is required to be made smaller to decrease the angle $\beta_0$ made between the material jet 2 and the wire, whereas the decrease in the angle $\beta_0$ made between the material jet 2 and the wire causes the position of the landing point 11 on the second wire 4 to largely vary simply by changing the direction of the material jet 2 slightly, and the positional adjustment (that is, the landing adjustment) of the landing point (in particular, the landing point 11 on the second wire 4) becomes more difficult as the operating speed of the paper machine becomes higher.

If the landing point 11 of the material jet 2 comes to a surface of the lead-in blade 20*a,* since the air layer incident to the plane of the material jet 2 disturbs the material jet 2 as mentioned above to hinder the formation of a paper layer, for example, defects on paper, including spotting (a phenomenon that a portion with no fibers appears on a surface of paper due to the entrainment of air) tends to occur more frequently as the operating speed of the paper machine increases. For this reason, there is a need to achieve the landing adjustment with high accuracy.

In addition, the decrease in the angle $\beta_0$ made between the material jet 2 and the second wire 4 causes the greater fluid wedge effect to take place between the material jet 2 and the second wire 4 as the operating speed of the paper machine becomes higher, and this fluid wedge effect produces a static pressure in a space between the material jet 2 and the second wire 4 to induce the disturbance of the plane of the material jet 2 (the interface between the material jet 2 and the air), which leads to easier occurrence of the paper defects including the aforesaid spotting.

Still additionally, also in a case in which the landing point 11 on the second wire 4 is positioned on the upstream side of the lead-in blade 20*a,* the landing point 10 on the first wire 3 is positioned in the vicinity of the upper end portion of the lead-in blade 20*a* at which both the wires converge, and the landing point 10 on the first wire 3 and the landing point 11 on the second wire 4 are shifted by a difference $\alpha_0$ from each other in the direction of the flow of the material jet 2 so that difficulty is experienced in conducting the simultaneous drainage in a section (the difference $\alpha_0$ section) from the landing point 11 on the second wire 4 to the landing point 10 on the first wire 3. The difficulty of the simultaneous drainage makes it difficult to secure the homogeneity of the surfaces of the paper layer on both sides of paper, and in particular, as the operating speed becomes higher, the degree of difficulty in securing the paper quality increases accordingly.

Meanwhile, in the case of a twin-wire former, with an increase in paper production speed, combined with the above-mentioned problems resulting from the material jet landing point, there exist requirements for the improvement of the dewatering performance including the enhancement of the dewatering ability of each drainage equipment (that is, increase in drainage quantity) and the improvement of the drainage balance between both the surfaces of paper.

Such enhancement of drainage performance effectively eliminates the troubles stemming from the aforesaid landing of the material jet 2, such as securing the aforesaid homogeneity of the paper layer surfaces or suppressing the occurrence of paper defects including the aforesaid spotting. That is, it is a significant object to improve the paper quality under the condition of high-speed operation.

Moreover, this requirement for the enhancement of the drainage performance exists with respect to not only the drainage equipment existing at the upstream end of the twin-wire former and in the vicinity of the material jet landing point but also each of the drainage equipments on the downstream side thereof.

Still moreover, not only to the twin-wire former, for example, but also to the on-top former or the multilayer former (see FIG. 9) in which the paper production gap defined in a manner that two wires converge is made in an intermediate section of the paper former, it is a significant object to enhance the drainage performance of each of the drainage equipments for improving the paper quality.

SUMMARY OF THE INVENTION

The present invention has been developed in consideration of the above-mentioned problems, and it is therefore an object of the invention to provide a former for use in paper production, which is capable of suppressing the occurrence of paper defects stemming from the landing of the jet or the occurrence of paper defects resulting from drainage to improve the paper quality.

For this purpose, in accordance with the present invention, there is provided a paper former comprising two wires which converge for defining a gap for paper production and a plurality of dewatering blades arranged in the paper production gap in a paper producing direction and brought into sliding contact with one of the two wires so that a stock is dehydrated while being conveyed in a state put in the paper production gap, wherein the plurality of dewatering blades are shaped into a convexly curved surface configuration bent along a traveling direction of the wire and equipped with a wire sliding contact surface brought into sliding contact with one of the two wires for guiding the traveling of the wire, and a moisture run-off opening is made in the wire sliding contact surface for the run-off of moisture due to the dewatering from the wire side.

This construction enables the dewatering to be efficiently made through the moisture run-off opening, thereby enhancing the drainage performance, which contributes to the improvement of the paper quality.

Preferably, the moisture run-off opening of each of the wire sliding contact surfaces of a portion of or all of the plurality of dewatering blades is formed throughout a section from an upstream side intermediate portion of the wire sliding contact surface to a downstream side end thereof except an upstream side end of the wire sliding contact surface.

With this construction, in the plurality of dewatering blades, a high drainage ability is attainable due to negative pressure effects in the moisture run-off opening formed from the intermediate portion of the wire sliding contact surface, which enhances the drainage performance and, hence, contributes to the improvement of the paper quality.

In addition, preferably, the paper production gap is made from the most upstream side portion of the former to which a stock is injected in a jetted fashion so that the former is constructed as a twin-wire former.

With this construction, the drainage performance at the former most-upstream portion is improvable and the injection of the stock becomes feasible with efficiency, which contributes to the suppression of the occurrence of paper defects stemming from the landing point of the jetted stock.

Still additionally, preferably, a former upstream side portion of the wire sliding contact surface of a first dewatering blade of the plurality of dewatering blades which is located at the former most-upstream portion has a curved surface configuration inclined to enlarge the paper production gap gradually toward the former upstream side, and the landing point of the jetted stock on the wire is set at a place where the moisture run-off opening exists on the wire sliding contact surface of the first dewatering blade.

This construction can easily provide a suitable landing point of the jetted stock, thus suppressing the occurrence of paper defects. Moreover, when the landing point is set at the moisture run-off opening made in the surface of the first dewatering blade for the run-off of the moisture, the moisture run-off opening can remove the air layer incident to the plane of the stock, which achieves the formation of a paper layer properly, thereby suppressing the occurrence of paper defects.

Furthermore, the wire sliding contact surface of the first dewatering blade of the plurality of dewatering blades, which is located at the former most-upstream portion, is formed into a curved surface configuration inclined to enlarge the paper production gap gradually toward the former upstream side, and the landing point of the jetted stock on the wire is set in the vicinity of the upstream end of the wire sliding contact surface of the first dewatering blade.

With this construction, in the first dewatering blade, a high drainage ability is attainable due to negative pressure effects in the moisture run-off opening formed from the intermediate portion of the wire sliding contact surface and the dewatering is made through the moisture run-off opening with high efficiency, which enhances the drainage performance and, hence, contributes to the improvement of the paper quality.

In this case, it is more preferable that the landing point is set at a portion which does not exist on the wire sliding contact surface but which is positioned on a slightly upstream side of the wire sliding surface.

Still furthermore, preferably, the paper production gap is made at a former intermediate portion so that the former is constructed as a former with a top wire including an on-top former and a multilayer former.

This construction enables the enhancement of the drainage performance of an on-top former, thereby improving the paper quality.

Yet furthermore, preferably, all of the plurality of dewatering blades are brought into sliding contact with one of the two wires.

With this construction, the efficient dewatering can be made with the drainage toward the exterior of the bending section of the dewatering blade by a centrifugal force applied to the stock along the bending of the dewatering blade and the drainage toward the interior of the bending section by each of dewatering blades being balanced, which enhances the drainage performance and, hence, contributes to the improvement of the paper quality.

Moreover, preferably, the dewatering blades constituting a portion of the plurality of dewatering blades are brought into sliding contact with one of the two wires while the remaining dewatering blades are brought into sliding contact with the other wire.

With this construction, the efficient dewatering can be made with the balance being kept with respect to the drainage toward the interior of the bending section by each of the dewatering blades, which enhances the drainage performance and, hence, contributes to the improvement of the paper quality.

Still moreover, a plurality of grooves are made in parallel in each of the wire sliding contact surfaces along the moving direction of the stock in a range from an upstream end side intermediate portion of the wire sliding contact surface to a downstream end portion thereof, except the upstream end portion of the wire sliding contact surface, so that the grooves function as the moisture run-off opening.

This construction can surely and smoothly achieve the occurrence of a negative pressure effect at the moisture run-off opening, the run-off of the moisture and the removal of the air layer incident to the plane of the jetted stock, which enables enhancing the drainage performance, avoiding the hindrance of the paper layer formation and certainly suppressing the occurrence of paper defects such as spotting, which leads to the improvement of the paper quality.

Yet moreover, preferably, the depth of each of the grooves increases gradually toward the moving direction of the stock.

This construction can control the rapid variation of the negative pressure stemming from the grooves to suppress the occurrence of paper defects. Moreover, the passage cross-sectional area of each of the grooves increases gradually toward the moving direction of the stock, and therefore, it is possible to adjust the passage cross-sectional area of each of the grooves to the moisture run-off quantity which increases as it proceeds to the downstream side. Accordingly, each of the grooves can easily be filled with the run-off moisture at all times, which prevents the attachment of dirt to the interior of the groove resulting from the drying of the interior of the groove, which leads to the improvement of the paper quality.

In addition, preferably, the direction of each of the grooves is inclined with respect to the moving direction of the stock.

With this construction, the grooves can uniformly carry out the moisture run-off of the stock in its cross directions in cooperation with each other.

Still additionally, preferably, for the two adjacent dewatering blades of the plurality of dewatering blades, the inclination directions of the grooves made in the wire sliding contact surfaces with respect to the stock moving direction are set to be different from each other (symmetrical with each other).

With this construction, the grooves can evenly carry out the moisture run-off of the stock in its cross directions in cooperation with each other, which leads to further improvement of the paper quality, and because it passes through the two dewatering blades, the fiber orientation is improvable, which contributes to the improvement of the paper quality.

In this case, more preferably, for the two adjacent dewatering blades, the inclination directions of the grooves made in the wire sliding contact surface with respect to the stock moving direction are set to be axial-symmetrical with each other.

BRIEF DESCRIPTION OF THE DRAWINGS

FIG. 1A is a side elevational view illustratively showing a section in the vicinity of a landing point of a jetted stock, FIG. 1B is an enlarged view showing an essential part of a first dewatering blade (lead-in blade) in FIG. 1A, FIG. 1C is an enlarged view showing an essential part of a second dewatering blade in FIG. 1A, and FIG. 1D is a front elevational view illustratively showing the first and second dewatering blades (an illustration of a section indicated by an arrow A in FIG. 1A);

FIG. 2A is a side elevational view illustratively showing a section in the vicinity of a landing point of a jetted stock, FIG. 2B is an enlarged view showing an essential part of a first dewatering blade (lead-in blade) in FIG. 2A and FIG. 2C is a front elevational view illustratively showing first and second dewatering blades (an illustration of a section indicated by an arrow B in FIG. 2A);

FIG. 5A is an illustration of a first example thereof, FIG. 5B is an illustration of a second example thereof and FIG. 5C is an illustration of a third example thereof.

DESCRIPTION OF THE PREFERRED EMBODIMENTS

Embodiments of the present invention will be described hereinbelow with reference to the drawings.

First of all, a description will be given hereinbelow of a first embodiment of the invention. FIGS. 1A to 1D are illustrations of a paper former (twin-wire former) according to the first embodiment of the invention.

Figure 1A:
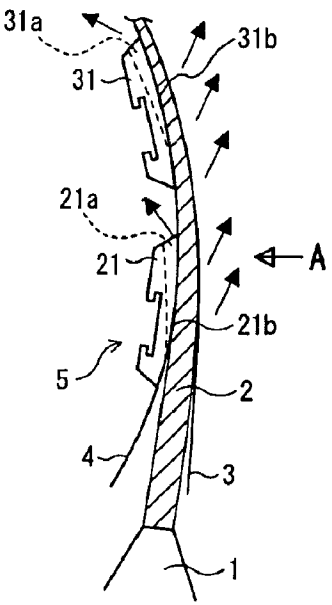
FIGS. 1A to 1D are illustrations of an essential part (first drainage equipment) of a paper former (twin-wire former) according to a first embodiment of the present invention.
Figure 1B:
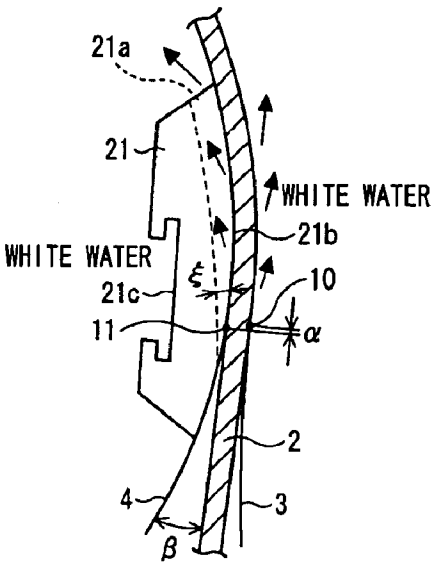
Figure 1C:
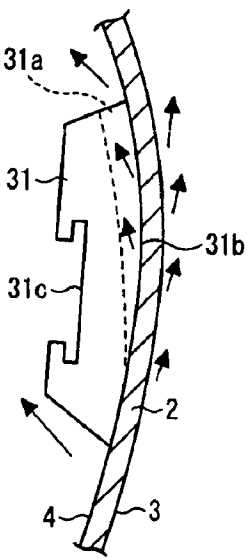

In FIGS. 1A to 1C and in FIGS. 2A and 2B to be described later, arrows designate illustrative flows of white water.

The paper former according to this embodiment is a twin-wire former which features a lead-in blade (first dewatering blade), a construction around the lead-in blade and a second dewatering blade on the immediately downstream side of the lead-in blade. The other portions are constructed similarly to those of the conventional example. The entire construction of a twin-wire former will first be described hereinbelow with reference to FIG. 6.

Figure 5A:
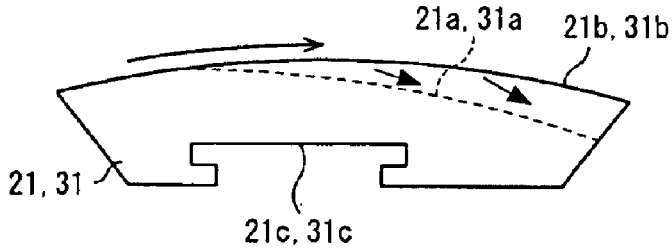
FIGS. 5A to 5C are side elevational views illustratively showing constructions of dewatering blades according to the embodiments of the present invention.
Figure 5B:
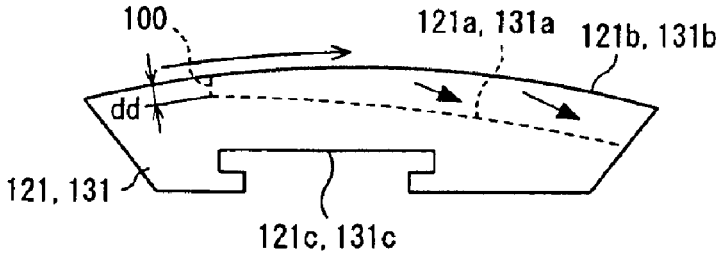
Figure 5C:
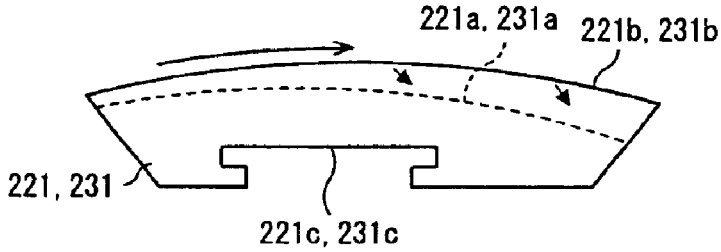
Figure 6:
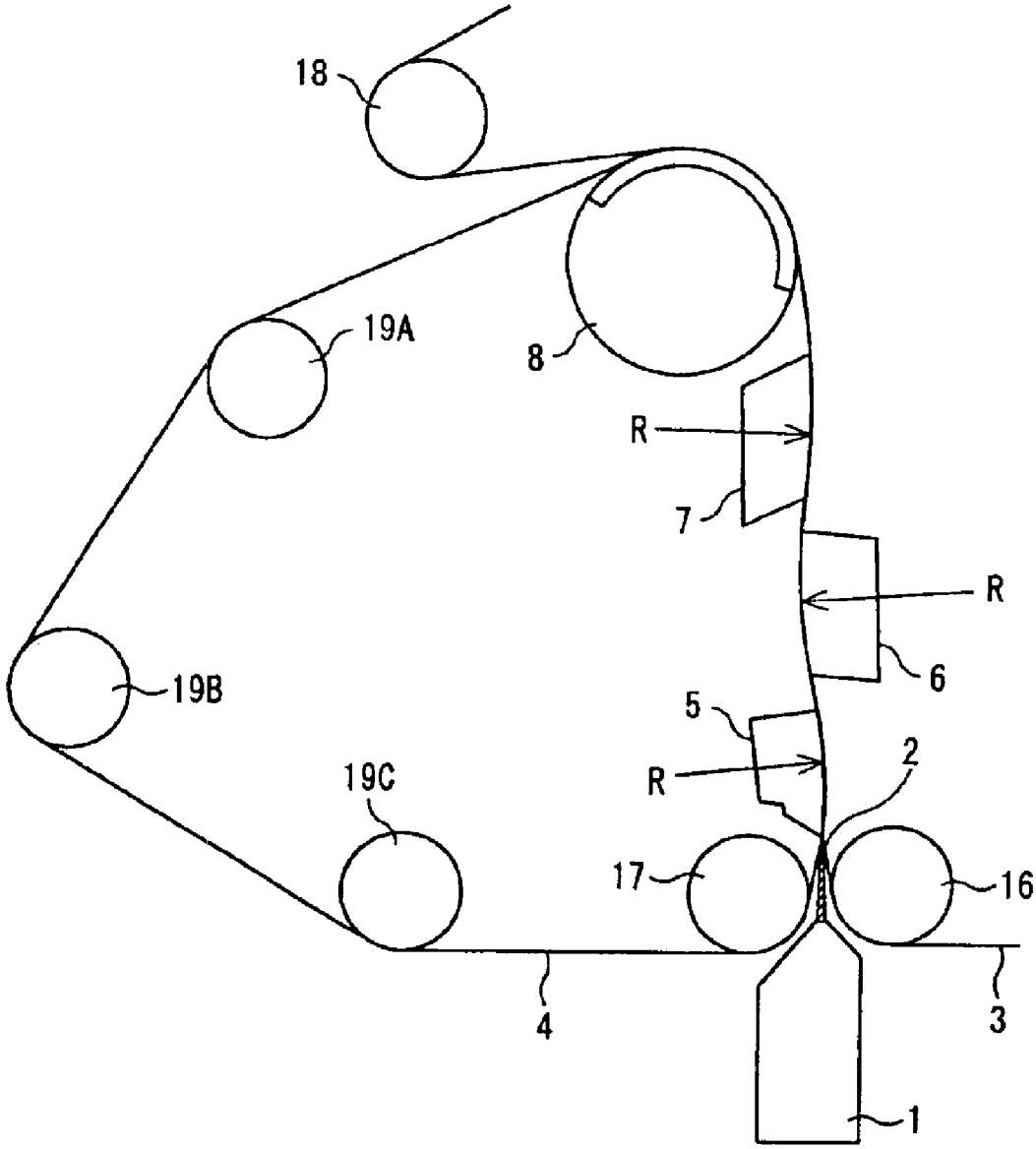
FIG. 6 RELATED ART
FIG. 6 is a side elevational view illustratively showing a construction of a conventional paper former (twin-wire former)
Figure 7:
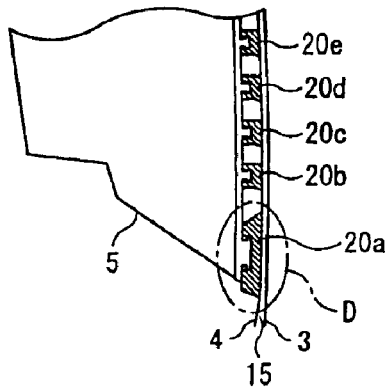
FIG. 7 RELATED ART
FIG. 7 is a side elevational view illustratively showing an essential part (first drainage equipment) of a conventional paper former (twin-wire former)

As FIG. 6 shows, as the entire construction of the twin-wire former according to this embodiment, a stock 2 is injected from a head box 1 in a jetted condition toward a gap (paper production gap) 15 defined, as shown in FIG. 5, by two mesh-like wires of a first wire (#1 wire) 3 and a second wire (#2 wire) 4, and the stock 2 grows into a paper layer while traveling through this gap 15.

The first wire 3 is guided by a forming roll 16, a guide roll 18 and others while the second wire is guided by a breast roll 17, guide rolls 19A to 19C, and others. Each of the wires 3 and 4 is rotationally driven to convey the stock 2 within the gap 15 in a predetermined direction, and the stock 2 travels within the gap 15 at a speed approximately equal to that of the wire 3, 4. Moreover, the gap 15 is gradually made narrower toward the downstream side in the traveling direction. On the upstream side of the gap 15, there are provided a first drainage equipment 5, a second drainage equipment 6 and a third drainage equipment 7 arranged in order, and on the downstream side of these drainage equipments, there are placed a suction couch roll 8 and others.

Figure 8:
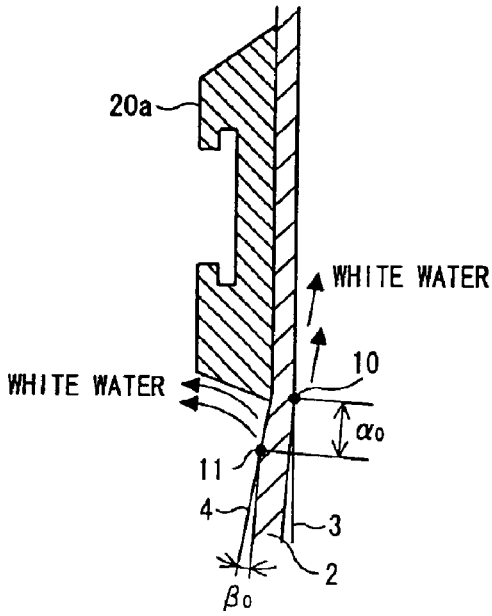
FIG. 8 RELATED ART
FIG. 8 is an illustrative side elevational view for explaining a landing point of a jetted stock in a conventional paper former (twin-wire former)

The first drainage equipment 5 is located within a loop of the second wire 4 which has a radius of curvature of R, where a plurality of dewatering blades (see FIG. 8) are placed in a state spaced from each other. The bottom wire 4 comes into sliding contact with the top surfaces (sliding contact surface) of these dewatering blades to travel in a loop fashion having a radius of curvature of R, and the top wire 3 also runs in a loop fashion with a radius of curvature of approximately R in a state where the stock 2 is interposed therebetween. While the stock 2 travels along a curved gap with a radius of curvature approximate to the radius of curvature R, the dewatering is achieved toward the both the wire 3 and 4 sides by means of drainage pressures taking place due to the bending of the top wire 3 and the bottom wire 4 according to the radii of curvature of the wires 3 and 4 on each of the dewatering blades 20; therefore, it grows gradually into a fibrous mat within the gap 15.

The second drainage equipment 6 is located within the loop of the first wire 3 which has a radius of curvature of R, and is equipped with a plurality of inhabited dewatering blades whereby the dewatering to the first wire 3 side is controlled by these inhabited dewatering blades, thus permitting only the drainage toward the second wire 4 side. The third drainage equipment 7 is equally referred to as a "suction box", and is located within the loop of the second wire 4 which has the radius of curvature of R. The third drainage equipment 7 and the suction couch roll 8 performs the drainage by means of vacuum, so the formation of a web takes place after the passage of a transfer box (not shown).

Incidentally, although the radius of curvature for each of the drainage equipments 5, 6 and 7 is set at R in this case, the present invention is not limited to this, but a construction in which they are not equal to each other is also acceptable.

Furthermore, both the wires 3 and 4 are made to converge in the vicinity of an upstream end of a first dewatering blade (called a "lead-in blade") existing at the most upstream position of the first drainage equipment 5 so that the gap 15 therebetween reaches a predetermined distance. A material jet 2 is made to land (arrive) at a place where both the wires 3 and 4 converge.

Referring to FIGS. 1A to 1D, a description will be given hereinbelow of, in this twin-wire former, a lead-in blade 21 with which the second wire (#2 wire) 4 comes into sliding contact (the second wire 4 slides on the lead-in wire 21).

As FIGS. 1A and 1B show, in this lead-in blade 21, a wire sliding contact surface 21*b* forming the top face (surface) thereof is bent along a traveling direction of the wire 4 to have a gently curved surface configuration convexly formed toward the wire 4 side.

That is, taking note of an upstream side portion of the wire sliding contact surface 21*b* in the moving direction of the material jet 2, it is constructed to have a curved surface configuration inclined to enlarge the paper production gap gradually toward the upstream end thereof (in other words, to separate gradually from the wire 4 toward the upstream end), and taking note of a downstream side portion of the wire sliding contact surface 21*b* in the moving direction of the material jet 2, it is designed to have a curved surface configuration inclined to separate gradually from the wire 4 toward the downstream end thereof. Naturally, the radius of curvature of this curved surface is smaller than the radius of curvature R of the second wire 4 for the first drainage equipment 5.

In addition, the landing point of the material jet 2 on the wire 4 is set at a place where the wire 4 comes into sliding contact with the wire sliding contact surface 21*b* the wire 4 hangs over. As mentioned above, since the wire sliding contact surface 21*b* of the lead-in blade 21 is made to have a curved surface inclined to enlarge the paper production gap gradually to the upstream end thereof, the distance between the two wires 3 and 4 can be lengthened at the upstream side section of the lead-in blade 21. Accordingly, the landing point 11 of the material jet 2 is naturally controllable to a point where the wire 4 comes into sliding contact with the wire sliding contact surface 21*b* of the lead-in blade 21.

Still additionally, if the landing point (#2 wire side material landing point) 11 of the material jet 2 is set at a place where the rear surface of the wire 4 is supported by the lead-in blade 21, distortion due to the landing of the material jet 2 does not easily occur in the wire, and for this reason, the angle β made between the material jet 2 and the wire 4 can be set to be relatively large in the vicinity of the landing point 11, which also facilitates the positional adjustment of the landing point 11 of the material jet 2.

Figure 1D:
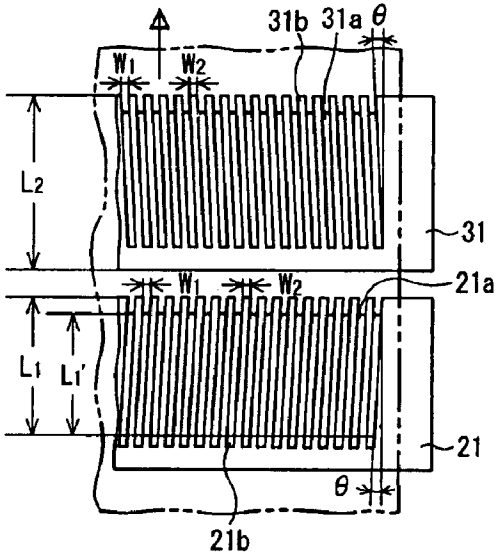

Furthermore, as FIG. 1D shows, in this wire sliding contact surface 21*b*, a plurality of grooves 21*a* are made in parallel with each other along the moving direction of the material jet 2. These grooves 21*a* are formed from an intermediate portion of the wire sliding contact surface 21*b* on its upstream end side to the downstream end portion thereof, except the upstream end portion of the wire sliding contact surface 21*b*, and function as a moisture run-off opening for the run-off of the moisture (white water) of the stock 2 which emerges from the wire 4 side by means of the dewatering, as indicated by arrows in FIGS. 1A and 1B.

In this connection, the grooves 21*a* are not made in the upstream end portion of the wire sliding contact surface 21*b*. This is for the purpose of securely guiding the traveling of the wire 4 to prevent the occurrence of deflection of the wire 4 for preventing the occurrence of paper defects stemming from the deflection of the wire 4.

In addition, the depth of each of the grooves 21*a* is designed to increase gradually in the moving direction of the stock 2, and the groove 21*a* is made in the form of the so-called "foil". That is, each of the grooves 21*a* is formed to become gradually deeper from an upstream side base point toward the downstream side. However, in this embodiment, the wire 4 is separated at a downstream end portion of the wire sliding contact surface 21*b*, and in this portion, even if each of the grooves 21*a* does not deepen in the moving direction of the stock 2, this is acceptable provided that the bottom surface of the groove 21*a* separates gradually from the wire 4.

The reason that each of the grooves 21*a* is made such that its depth increases gradually from the upstream side to the downstream side is that a space appears outside the wire 4 due to the groove 21*a* and a negative pressure occurs in this groove 21*a* portion when the stock 2 travels together with the wire 4. This negative pressure acts suitably for the run-off of the moisture of the stock 2, but a disturbance occurs in the plane (interface with air) of the stock 2 when the negative pressure works rapidly, which positively causes the occurrence of paper defects. For this reason, the groove is made such that its depth increases gradually from the upstream side to the downstream side.

Still additionally, although each of the grooves 21*a* functions as a passage for the moisture resulting from the drainage of the stock 2, the passage cross-sectional area of the groove 21*a* increases gradually in the moving direction of the stock 2 so that the passage cross-sectional area of each of the grooves 21*a* is adjustable to the run-off moisture quantity which increases toward the downstream side. In particular, dirt tends to stick to the interior of each of the grooves 21*a* when the groove 21*a* gets dry, but if the interior of the groove 21*a* is filled with the run-off moisture at all times, this problem is solvable. The aforesaid groove depth is set in consideration of this fact.

In view of the prevention of the rapid variation of the negative pressure, additionally, there is a need to, at the base point of the groove 21*a* (upstream side end portion), set the angle ϵ, made between the bottom surface of the groove 21*a* and the wire sliding contact surface 21*b*, to a small value, and for example, the angle ϵ is set at 10° to 5°. If consideration is given to only the negative pressure rapid variation prevention, a smaller angle ϵ is preferable, whereas there is a need to secure the passage cross-sectional area and, therefore, the angle ϵ is required to be set in consideration of these facts.

Moreover, in general, conceptually, the negative pressure increases as the groove 21*a* becomes deeper (as the angle ϵ becomes larger), but actually, it is a given fact that the groove volume is sufficiently filled with the white water. The drainage quantity varies with the material property (paper kind) or the location of the dewatering blades, and the generation level of the negative pressure varies accordingly. Still moreover, even an extremely large depth can reduce the negative pressure. Thus, the angle ϵ will be set according to these conditions, and it is not limited to the aforesaid angle range.

Furthermore, in this embodiment, as FIG. 1C shows, the direction of each of the grooves 21*a* is inclined in a cross (width) direction by a predetermined inclination (angle) θ with respect to the moving direction of the stock 2. This enables the moisture run-off of the stock 2 to take place equally. In this case, the moisture run-off takes place at any one of portions of each of the grooves 21*a* throughout the overall width of the stock 2 in the wire 4 while the wire 4 travels in a state brought into contact with the wire sliding contact surface 21*b*.

Concretely, in this embodiment, the width $W_1$ of each of the grooves 21*a* and the separation $W_2$ between the grooves 21*a* are set to be approximately or substantially equal to each other (for example, 3 to 4 mm), and as expressed by the following equation (1), the inclination θ is set in relation to the inter-groove separation $W_2$ and the sliding contact length $L_1'$ of the wire 4 with respect to the wire sliding contact surface 21*b*.

$$\tan\theta \geqq W_2/L_1' \quad (1)$$

The friction between one edge of each of grooves 21*a* and the wire 4, which comes into sliding contact therewith, increases as the inclination θ becomes larger, and in view of this, it is preferable that the inclination θ is smaller. Thus, for the inclination θ to be set to be smaller and for the stock 2 to be brought into contact with the groove 21*a* throughout its overall width at any one of positions of the groove 21*a* in longitudinal directions, $\tan\theta = W_2/L_1'$ holds.

Still furthermore, in this embodiment, although the wire 4 does not come into contact with the wire sliding contact surface 21*b* at a downstream end portion of the lead-in blade 21, it is also possible that the wire 4 is brought into contact with the wire sliding contact surface 21*b* over a range from the landing point 11 to the downstream end of the lead-in blade 21. In this case, the sliding contact length of the wire 4 on the wire sliding contact surface 21*b* becomes $L_1$ as shown in FIG. 1C, and the inclination θ is set as expressed by the following equation (2).

$$\tan\theta \geqq W_2/L_1 \quad (2)$$

Incidentally, as well as a conventional technique, a key groove 21*c* for fixing to a proximal portion of the first drainage equipment 5 is made in the rear surface of the lead-in blade 21, and the lead-in blade 21 is attachable/detachable to/from the proximal portion of the first drainage equipment 5 in the cross directions. Naturally, it is securely fixed thereto in the traveling direction of the wire 4 when attached.

Secondly, referring to FIGS. 1A to 1D, a description will be given hereinbelow of a second dewatering blade 31 located to be adjacent to the lead-in blade 21 on the downstream side of the lead-in blade 21 (former downstream side portion: the downstream side in the moving directions of the wires 3 and 4).

As FIGS. 1A and 1C show, also in this second dewatering blade 31, a wire sliding contact surface 31*b* forming its top surface (face) is bent along a traveling direction of the wire 4 to have a gently curved surface configuration convexly formed toward the wire 4 side. The radius of curvature of the curved surface constituting the sliding contact surface 31*b* is set to be approximately equal to or slightly smaller than the radius of curvature R of the second wire 4 in the first drainage equipment 5, and the wire 4 is brought into sliding contact with the wire sliding contact surface 31*b* throughout the almost overall length thereof in the traveling direction of the wire 4.

Also in this second dewatering blade 31, an upstream side portion of the wire sliding contact surface 31*b* can be constructed to have a curved surface configuration inclined so that the paper production gap widens microscopically and gradually toward an upstream end thereof for initially bringing the wire 4 into contact with the wire sliding contact surface 31*b* at a slightly downstream side position of the upstream end thereof, thus accomplishing the smooth contact of the wire 4 with the wire sliding contact surface 31*b*.

In addition, as FIG. 1D shows, also in this second dewatering blade 31, a plurality of grooves 31*a* are made in parallel in the wire sliding contact surface 31*b* along the moving direction of the material jet 2. These grooves 31*a* are formed from an intermediate portion of the wire sliding contact surface 31*b* on its upstream end side to the downstream end portion thereof, except the upstream end portion of the wire sliding contact surface 31*b*, and function as a moisture run-off opening for the run-off of the moisture (white water) of the stock 2 which emerges from the wire 4 side by means of the dewatering, as indicated by arrows in FIGS. 1A and 1C.

Still additionally, as in the case of the lead-in blade 21, the depth of each of the grooves 31*a* of the second dewatering blade 31 is designed to increase gradually in the moving direction of the stock 2, and the groove 31*a* is made in the form of the so-called "foil". That is, each of the grooves 31*a* is formed to become gradually deeper from an upstream side base point toward the downstream side. However, when the wire 4 is separated at a downstream end portion of the wire sliding contact surface 31*b*, even if each of the grooves 31*a* in this portion does not deepen gradually in the moving direction of the stock 2, this is acceptable provided that the bottom surface of the groove 31*a* separates gradually from the wire 4.

The reason that each of the grooves 31*a* is made such that its depth increases gradually from the upstream side to the downstream side is that a space appears outside the wire 4 due to the groove 31*a* and a negative pressure occurs in this groove 31*a* portion when the stock 2 travels together with the wire 4. This negative pressure acts suitably for the run-off of the moisture of the stock 2, but a disturbance occurs in the plane (interface with air) of the stock 2 when the negative pressure works rapidly, which positively causes the occurrence of paper defects. For this reason, the groove is made such that its depth increases gradually from the upstream side to the downstream side.

Meanwhile, the grooves 31*a* are not made in the upstream side portion of the wire sliding contact surface 31*b*. As with the lead-in blade 21, this is for the purpose of performing a function to guiding the traveling of the wire 4 securely by the wire sliding contact surface 31*b* to prevent the occurrence of the deflection of the wire 4 for avoiding the occurrence of paper defects resulting from the deflection of the wire 4, and is for exhibiting a more important function which will be mentioned hereinbelow.

That is, the wire 4, together with the stock 2, comes into contact with the wire sliding contact surface 31*b* in a state pressed from the upstream end portion of the wire sliding contact surface 31*b* where the grooves 31*a* do not exist, and then passes through the intermediate and downstream portions of the wire sliding contact surface 31*b* where the grooves 31*a* exist. When the wire 4 passes from the groove 31*a* non-formed portion to the groove 31*a* formed portion, the wire 4 side stock 2, which so far has been in a nearly hermetic condition made by the wire sliding contact surface 31*b* with no groove 31*a*, is released therefrom by the groove 31*a* constituting an opening, thereby generating the so-called negative pressure.

This negative pressure effect leads the moisture (white water) of the stock 2 to the interior of each of the grooves 31*a* by a quantity considerably larger than the negative pressure occurring due to the gradual increase of the depth of the groove 31*a* from the upstream side to the downstream side, thus producing a strong dewatering effect. This construction, in which the grooves 31*a* are not made in the upstream end portion of the wire sliding contact surface 31*b* but they are made from the intermediate portion of an upstream section of the wire sliding contact surface 31*b* to the downstream end portion thereof, is for the purpose of creating the strong drainage effect owing to this negative pressure.

In addition, although each of the grooves 31*a* functions as a passage for the moisture resulting from the drainage of the stock 2, the passage cross-sectional area of the groove 31*a* increases gradually in the moving direction of the stock 2 so that the passage cross-sectional area of each of the grooves 31*a* is adjustable to the run-off moisture quantity which increases toward the downstream side. In particular, dirt tends to stick to the interior of each of the grooves 31*a* when the groove 31*a* gets dry, but if the interior of the groove 31*a* is filled with the run-off moisture at all times, this problem is solvable. The aforesaid groove depth is set in consideration of this fact.

In view of the prevention of the rapid variation of the negative pressure, as in the case of the grooves 21*a,* there is a need to, at the base point of the groove 31*a* (upstream side end portion), set the angle $\epsilon$, made between the bottom surface of the groove 31*a* and the wire sliding contact surface 31*b,* to a small value. On the other hand, the angle $\epsilon$ is needed to be increased to some extent for securing the passage cross-sectional area; therefore, the angle $\epsilon$ is set in consideration of these facts.

Still additionally, as mentioned above, conceptually, the negative pressure increases as the groove 31*a* becomes deeper (as the angle $\epsilon$ becomes larger), but actually, it is a given fact that the groove volume is sufficiently filled with the white water. The drainage quantity varies with the material property (paper kind) or the location of the dewatering blades, and the generation level of the negative pressure varies accordingly. Yet additionally, even an extremely large depth can reduce the negative pressure. Thus, the angle $\epsilon$ will be set according to these conditions.

Moreover, it is considered that the second dewatering blade 31 suffers a smaller effect of the rapid variation of the negative pressure as compared with the lead-in blade 21, and in this respect, the angle $\epsilon$ of the groove 31*a* can be set to be larger than that of the groove 21*a.*

Furthermore, in this embodiment, as FIG. 1D shows, the direction of each of the grooves 31*a* of the second dewatering blade 31 is also inclined in a cross direction by a predetermined inclination $\theta$ with respect to the moving direction of the stock 2. This is for accomplishing the uniform moisture run-off of the stock 2 in the cross directions, and it is the same as the inclined groove 21*a* of the lead-in blade 21. Concretely, the width $W_1$ of each of the grooves 31*a* and the separation $W_2$ between the grooves 31*a* are set to be approximately equal to each other (for example, approximately 3 to 4 mm), and the inclination $\theta$ is set in relation to the inter-groove separation $W_2$ and the sliding contact length $L_2$ of the wire 4 with respect to the wire sliding contact surface 31*b* to satisfy the foregoing equation (1) or (2) (in this case, "$L_1$" of each of the equations is replaced with "$L_2$"). This is similar to the inclination of the each of the grooves 21*a* of the lead-in blade 21, and the detailed description thereof will be omitted for brevity.

However, in the second dewatering blade 31, the inclination direction of each of the grooves 31*a* is set to be laterally opposite to or different from the inclination direction of each of the grooves 21*a* of the lead-in blade 21. In other words, each of the grooves 31*a* of the second hydrating blade 31 is made to be axial-symmetrical with each of the grooves 21*a* laterally (in the right-and-left directions) with respect to the traveling direction of the wire 4. This is for, because the lateral inclination of the groove 21*a* of the lead-in blade 21 is considered to affect the mobility of the paper fibers of the stock 2, equalizing the mobility of the paper fibers of the stock 2 laterally.

The paper former (twin-wire former) according to the first embodiment of the present invention is constructed as described above, and the function thereof is as follows.

That is, since an upstream side portion of the wire sliding contact surface 21*b* in the moving direction of the material jet 2 is formed to have a curved surface configuration inclined to enlarge the paper production gap gradually toward the upstream end thereof, it is possible to lengthen the distance between the two wires 3 and 4 at the upstream side portion of the lead-in blade 21, which facilitates the setting of the landing point 11 of the material jet 2 at a place where the wire 4 comes into sliding contact with the wire sliding contact surface 21*b* of the lead-in blade 21.

In addition, when the landing point (#2 wire side material landing point) 11 of the material jet 2 is set on the lead-in blade 21, it is possible to easily reduce the difference $\alpha$ between the landing point 11 and the landing point (#1 wire side material landing point) 10 of the material jet 2 on the wire 3 in the flowing direction of the material jet 2, which permits the simultaneous drainage of the jet 2 at the landing points, thus securing the homogeneity of the paper layer surfaces on both the sides of the paper for achieving the paper quality required.

Still additionally, when the landing point 11 of the material jet 2 is set at a place where the rear surface of the wire 4 is supported by the lead-in blade 21, the deflection becomes hard to cause due to the landing of the material jet 2 and, hence, the angle $\beta$ made between the material jet 2 and the wire 4 can be set to be relatively large in the vicinity of the landing point 11, which facilitates the positional adjustment of the landing-point 11 of the material jet 2.

In particular, although the landing points 10 and 11 of the material jet 2 varies according to the paper production speed (speeds of the wires 3 and 4), the thickness (gap 15) of the stock 2, the drainage property of the stock 2 and others, because the positional adjustment (landing adjustment) of the landing point 11 is facilitated, it is possible to easily cope with the variation of any one of these factors, which lessens the work load needed for the landing adjustment, shortens the work time needed therefor, and enables proper adjustment of the landing point.

Moreover, when the angle $\beta$ made between the material jet 2 and the wire 4 is set to be relatively large, less fluid wedge effect occurs between the material jet 2 and the second wire 4, which leads to the reduction of the static pressure occurring in a space between the material jet 2 and the second wire 4 due to this fluid wedge effect, thereby suppressing the disturbance of the plane of the material jet 2 (interface between the material jet 2 and the air) to inhibit easy occurrence of paper defects including spotting.

Still moreover, when the landing point 11 of the material jet 2 arrives on the wire sliding contact surface 21*b* of the lead-in blade 21, an air layer incident to the plane of the material jet 2 disturbs the material jet 2 between it and the wire sliding contact surface 21*b* to hinder the formation of a paper layer. However, since, in this wire sliding contact surface 21*b,* the plurality of grooves 21*a* are made in parallel along the moving direction of the material jet 2, the air layer incident to the plane of the material jet 2, together with the moisture of the material jet 2 dehydrated, gets out from the wire 4 side through the grooves 21*a;* in consequence, no disturbance occurs in the material jet 2, thus achieving proper paper layer formation.

In particular, when the grooves 21*a* are made in the wire sliding contact surface 21*b,* the wire 4 is not supported at the groove 21*a* portion so that the deflection of the wire 4 tends to occur. However, in this embodiment, since the grooves 21*a* are not made in an upstream end portion of the wire sliding contact surface 21*b,* the wire 4 can securely be supported by the upstream end portion of the wire sliding contact surface 21*b,* thus preventing the occurrence of the deflection of the wire 4 to suppress the occurrence of paper defects stemming from the deflection of the wire 4.

Furthermore, since the depth of each of the grooves 21*a* is made to have a foil configuration so that it increases gradually in the moving direction of the stock 2 and the angle $\epsilon$ made between the bottom surface of the groove 21*a* and the wire sliding contact surface 21*b* at the base point (upstream side end portion) of the groove 21*a* is set at a small value, a moderate negative pressure develops at this groove 21*a* portion when the wire 4 and the stock 2 travel, which suppresses the rapid pressure variation at the plane (interface with air) of the stock 2 to hold down the disturbance of the plane of the stock 2, thereby controlling the occurrence of paper defects.

Still furthermore, each of the grooves 21*a* increases gradually in passage cross-sectional area toward the moving direction of the stock 2 to adjust the passage cross-sectional area of each of the grooves 21*a* to the quantity of the run-off moisture which increases toward the downstream side, which enables the groove 21*a* to be filled with the run-off moisture at all times. If the interior of the groove 21*a* gets dry, dirt tends to stick to the interior of the groove 21*a*. However, since the groove 21*a* is filled with the run-off moisture at all times, the sticking of the dirt is preventable.

In addition, in this embodiment, since the direction of each of the grooves 21*a* of the lead-in blade 21 is inclined by a predetermined inclination $\theta$ in the width direction with respect to the moving direction of the stock 2, the run-off of the moisture of the stock 2 can equally be done in the width direction. In particular, when the inclination $\theta$ is set in relation to the inter-groove distance $W_2$ and the sliding contact length $L_1'$ of the wire 4 with the wire sliding contact surface 21*b* as expressed by the aforesaid equation (1), the moisture run-off takes place at any one of portions of each of the grooves 21*a* throughout the overall width of the stock 2 in the wire 4, which enables the uniform moisture run-off in the width direction, thus improving the paper quality.

The stock 2 after the drainage treatment by the lead-in blade 21 proceeds to the second dewatering blade 31 existing on the immediately downstream side of the lead-in blade 21 by means of the driving of the wire 4, and further drainage treatment is performed by the second dewatering blade 31.

In this second dewatering blade 31, when being driven by the wire 4, the stock 2 first comes into pressurized contact with the upstream end portion of the wire sliding contact surface 31*b* with no grooves 31*a,* and then passes through the intermediate and downstream portions of the wire sliding contact surface 31*b* with the grooves 31*a*. Thus, when the stock 2 first passes through the groove 31*a* non-formed portion and then through the groove 31*a* formed portions in this way, the stock 2 is released from a nearly hermetically sealed condition, made by the groove 31*a* non-formed portion of the wire sliding contact surface 31*b,* by means of the grooves 31*a* forming an opening, thereby producing the so-called negative pressure effect.

Owing to this negative pressure effect, the moisture (white water) of the stock 2 is absorbed into the interior of the grooves 31*a,* thereby exhibiting a powerful dewatering action. In addition to this, owing to the foil structure in which the depth of each of the grooves 31*a* increases gradually from the upstream side portion to the downstream side portion, a negative pressure takes place, which also contributes to the dewatering action. Also by the second dewatering blade 31, the stock 2 is powerfully dehydrated in this way.

As a result, since the stock 2 is dehydrated continuously by the high drainage ability of the lead-in blade 21 and the higher drainage ability of the second dewatering blade 31 subsequent thereto, considerable drainage takes place at the upstream side section (first drainage equipment 5) of the former.

The wire 3 side plane of the stock 2 is dehydrated toward the exterior of the wire 3 by means of a centrifugal force corresponding to the radius of curvature R, and in a case in which the paper machine is operated at a high speed, the centrifugal force becomes large to enhance the drainage ability for the wire 3 side plane of the stock 2; therefore, a high drainage ability is required for the wire 4 side plane of the stock 2. In this embodiment, since the lead-in blade 21 and the second dewatering blade 31 subsequent thereto provide a high drainage ability as mentioned above, even under the high-speed operation, it is possible to dehydrate both the planes of the stock 2 equally, thus improving the quality of paper produced.

Moreover, also in this second dewatering blade 31, the grooves 31*a* are not made in an upstream end portion of the wire sliding contact surface 31*b* and, hence, in addition to the production of the aforesaid negative pressure effect, the upstream end portion of the wire sliding contact surface 31*b* surely supports the wire 4 to prevent the deflection of the wire 4, which suppresses the occurrence of paper defects stemming from the deflection of the wire 4.

Still moreover, since the depth of each of the grooves 31*a* of the second dewatering blade 31 is made to increase gradually toward the moving direction of the stock 2 for the formation of a foil configuration and the angle $\xi$ made between the bottom surface of the groove 31*a* and the wire sliding contact surface 31*b* at the base point of the groove 31*a* (upstream side end portion) is set at a small value, an excessively large negative pressure develops at this groove 31*a* portion when the wire 4 and the stock 2 move, which suppresses the excessively rapid pressure variation on the plane (interface with air) of the stock 2 for preventing the excessive occurrence of disturbance on the plane of the stock 2, thereby controlling the occurrence of paper defects.

In addition, since the passage cross-sectional area of each of the grooves 31*a* of the second dewatering blade 31 increases gradually toward the moving direction of the stock so that the passage cross-sectional area of each of the grooves 31*a* adjusts to the quantity of the run-off moisture which increases as it advances to the downstream side, it is possible that the interior of each of the grooves 31*a* is easily filled with the run-off moisture at all times. When the interior of the groove 31*a* gets dry, the dirt tends to stick to the interior of the groove 31*a*. However, if the groove 31*a* is filled with the run-off moisture at all times, this problem is solvable.

Still additionally, in this embodiment, as well as the direction of each of the grooves 21*a* of the lead-in blade 21, the direction of each of the grooves 31*a* of the second dewatering blade 31 is inclined by the predetermined inclination $\theta$ with respect to the moving direction of the stock 2;

therefore, the uniform run-off of moisture of the stock 2 in the cross direction is feasible. In particular, if the inclination θ is set in relation to the inter-groove separation $W_2$ and the sliding contact length $L_2$ of the wire 4 with respect to the wire sliding contact surface 31*b* as expressed by the aforesaid equation (1), the moisture run-off can be made at any one of portions of each of the grooves 31*a* throughout the overall width of the stock 2 in the wire 4, which achieves more uniform moisture run-off in the cross direction to improve the paper quality.

Yet additionally, since the inclination direction of each of the grooves 31*a* of the second dewatering blade 31 is set to be opposite laterally to the inclination direction of each of the grooves 21*a* of the lead-in blade 21, it is possible to laterally equalize the mobility of the paper fibers in the stock.

Figure 2C:
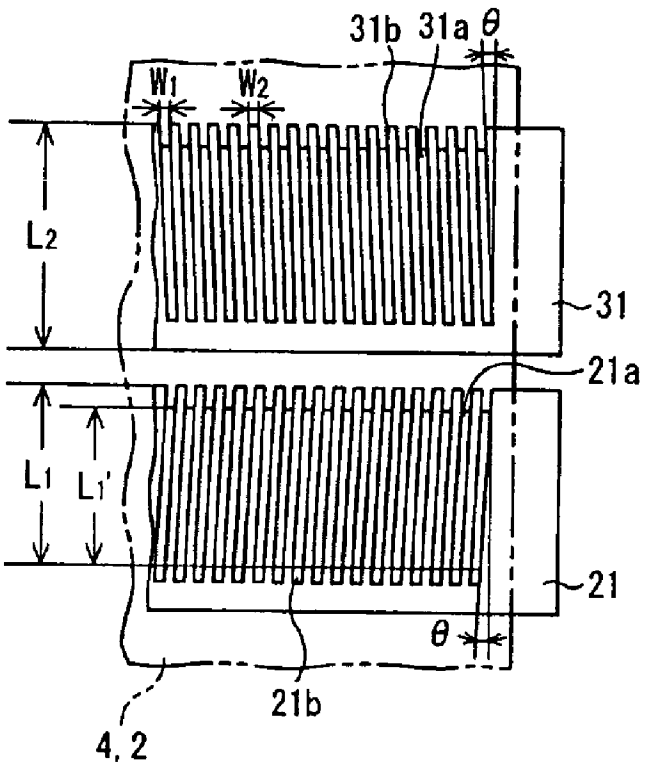
FIGS. 2A to 2C are illustrations of an essential part (first drainage equipment) of a paper former (twin-wire former) according to a second embodiment of the present invention.

Furthermore, a description will be given hereinbelow of a second embodiment of the present invention. FIGS. 2A to 2C are illustrations of a paper former (twin-wire former) according to the second embodiment of the invention. FIG. 2A is a side elevational view illustratively showing a section in the vicinity of a landing point of a jetted stock, FIG. 2B is an enlarged illustration of an essential part of a first dewatering blade (lead-in blade) portion in FIG. 2A, and FIG. 2C is a front elevational view illustratively showing first and second dewatering blades (an illustration of a section indicated by an arrow B in FIG. 2A).

In the above-described first embodiment, the landing point 11 of the material jet 2 is set at a portion where the grooves 21*a* are made on the wire sliding contact surface 21*b* of the lead-in blade 21. On the other hand, in a case in which the operating speed is not high, or in a case in which the difference α between the landing point 10 on the first wire 3 and the landing point 11 on the second wire 4 in the flow direction of the material jet 2 does not produce a big barrier in securing the homogeneity of the surfaces of a paper layer, it is also appropriate that the landing point 11 of the material jet 2 is set immediately before a place where the first wire 3 comes into sliding contact with the wire sliding contact surface 21*b* of the lead-in blade 21.

Figure 2B:
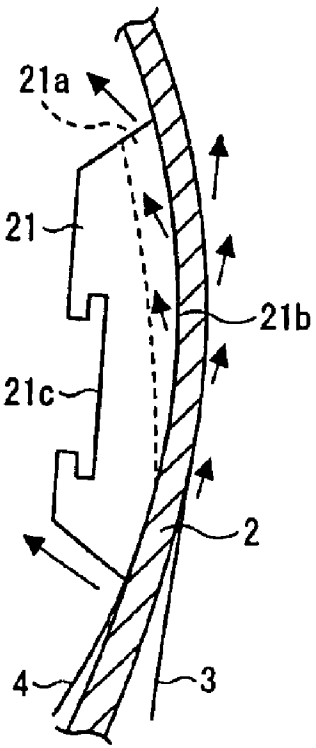
Figure 2A:
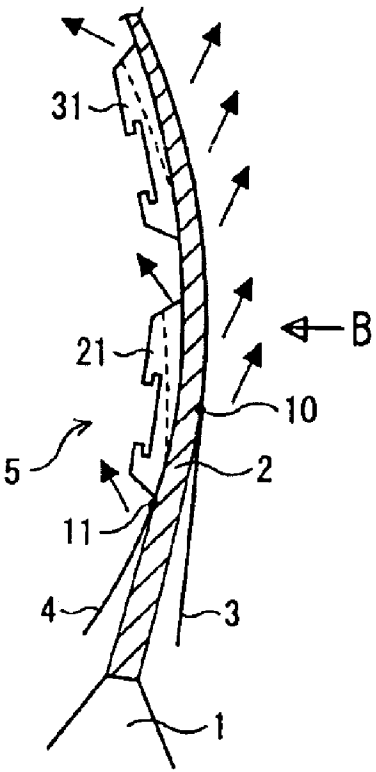

In this embodiment, as FIGS. 2A and 2B show, the landing point 11 of the material jet 2 on the second wire 4 is placed on the upstream side of the sliding contact portion with the lead-in blade 21, particularly, immediately before a place where the first wire 3 comes into sliding contact with the lead-in blade 21.

The other portions of the lead-in blade 21, the second dewatering blade 31 and others are constructed similarly to those of the first embodiment, and the description thereof will be omitted.

In the paper former (twin-wire former) according to the second embodiment of the present invention thus constructed, as well as the first embodiment, a high drainage ability is attainable by the lead-in blade 21 and the second dewatering blade 31, which enables the improvement of the quality of paper obtained through the paper production.

Meanwhile, in this embodiment, the difference α between the landing point 10 on the first wire 3 and the landing point 11 on the second wire in the flow direction of the material jet 2 becomes larger than that of the first embodiment, and in this portion, difficulty is encountered in almost simultaneously conducting the dewatering on the first wire 3 side and the second wire 4 side so that difficulty is experienced in securing the homogeneity of the paper layer surfaces on both the sides of paper. However, depending upon the setting of the dewatering characteristic afterwards (after the landing points 10 and 11), or in a case in which the operating speed is not high, it is possible to secure the homogeneity of the paper layer surfaces on both the sides of paper.

That is, when the landing point 11 of the material jet 2 is set immediately before a place where the wire 3 comes into sliding contact with the wire sliding contact surface 21*b* of the lead-in blade 21, the stock 2 is released from the almost hermetically sealed condition made by the wire sliding contact surface 21*b* with no grooves 21*a* so that a so-called negative pressure effect takes place. This enhances greatly the drainage ability of the lead-in blade 21. It goes without saying that the second dewatering blade 31 exhibits a high drainage ability through the use of the negative pressure effect.

The wire 4 side portion of the stock 2 can powerfully be dehydrated by the lead-in blade 21 and the second dewatering blade 31 having a high drainage ability and located successively, and the drainage ability can be set in a wide range by the configuration setting (setting of the depth, angle ϵ and others) of the grooves 21*a* and 31*a* of the lead-in blade 21 and the second dewatering blade 31. On the other hand, the drainage ability for the second wire 4 side portion of the stock 2 depends upon the radius of curvature of the drainage equipment or the speeds of the wires 3 and 4. Accordingly, if the drainage ability for the wire 3 side portion of the stock 2 is properly set according to the drainage ability for the wire 4 side portion of the stock 2 which is obtained by the setting of the lead-in blade 21 and the second dewatering blade 31, it is possible to eliminate the dewatering difference between both the sides of paper stemming from the difference α between the landing points 10 and 11.

Meanwhile, if the landing point 11 on the second wire 4 is set at an upstream side solid portion (portion with no opening) of the lead-in blade 21 as mentioned above, the removal of the air layer incident to the plane of the material jet 2 becomes difficult so that this air layer disturbs the material jet 2 to hinder the formation of a paper layer. However, in this case, also when the landing point 11 of the material jet 2 is set at the portion with no grooves 21*a* existing in the upstream side section of the wire sliding contact surface 21*b* of the lead-in blade 21, the stock 2 is released from the almost hermetically sealed condition, produced by the wire sliding contact surface 21*b* with no grooves 21*a*, by means of the grooves 21*a* forming an opening so that the so-called negative pressure effect takes place to greatly improve the drainage ability of the lead-in blade 21. Since the second dewatering blade 31 also naturally displays a high drainage ability through the use of the negative pressure effect, both the dewatering blades 21 and 31 powerfully carry out the drainage of the stock 2 in cooperation with each other. Accordingly, depending upon the paper production conditions, even if the landing point 11 is set at the upstream side solid portion (portion with no opening) of the lead-in blade 21, the air layer incident to the material jet 2 is removed at the groove 21*a* portion lying on the downstream side of the landing point 11, which permits the paper production without any troubles.

Figure 3:
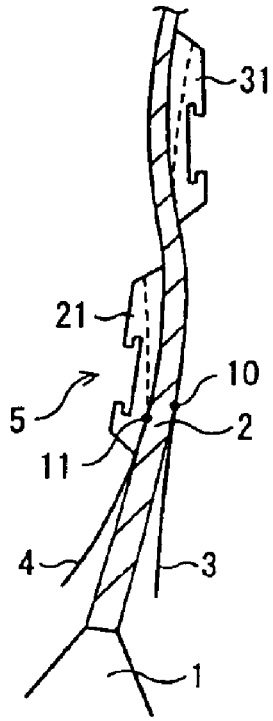
FIG. 3 is an illustration of an essential part (first drainage equipment) of a paper former (twin-wire former) according to a third embodiment of the present invention, and is a side elevational view illustratively showing a section in the vicinity of a landing point of a jetted stock.

Furthermore, a description will be given hereinbelow of a third embodiment of the present invention. FIG. 3 shows a paper former (twin-wire former) according to the third embodiment of the invention, and is a side elevational view illustratively showing a section in the vicinity of a landing point of a jetted stock.

As FIG. 3 shows, the difference of this embodiment from the first embodiment is that a second dewatering blade 31 is placed on the opposite side to a lead-in blade 21.

That is, the lead-in blade 21 is brought into sliding contact with a second wire 4 in the vicinity of a landing point of a material jet 2, while the second dewatering blade 31 is brought into sliding contact with a first wire 3 at a position close to the lead-in blade 21 on the downstream side of the lead-in blade 21.

Incidentally, the configurations of the wire sliding contact surfaces 21*b*, 31*b* and grooves 21*a*, 31*a* of the dewatering blades 21, 31 are made to be similar to those of the first and the second embodiments.

In addition, in this case, although the landing points of the material jet 2 are set similarly to those of the first embodiment, depending upon various conditions, it is also appropriate that they are set similarly to those of the second embodiment.

Since a paper former (twin-wire former) according to the third embodiment of the present invention is constructed as mentioned above, as well as the first and second embodiments, the lead-in blade 21 and the second dewatering blade 31 provide a high drainage ability, thus achieving the improvement of the quality of paper produced.

Meanwhile, the above-described constructions of the lead-in blades 21 and the second dewatering blades 31 are widely applicable not only to a twin-wire former but also to dewatering blades of other paper formers. Moreover, the constructions of the dewatering blades 21 and 31 are also applicable not only to drainage equipments on the immediately downstream side of the landing of a material jet 2 but also to drainage equipments existing on the further downstream side thereof.

Figure 4:
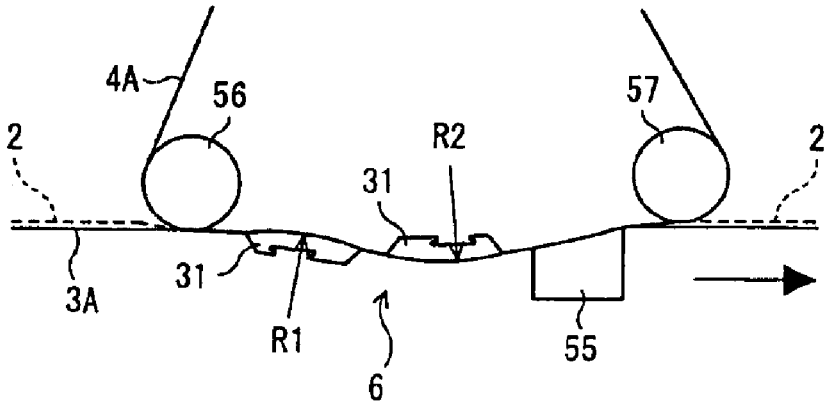
FIG. 4 is a side elevational view illustratively showing a construction of an essential part of a paper former (on-top former or multilayer former) according to a fourth embodiment of the present invention.

A description will be given hereinbelow of a fourth embodiment constituting an application example other than the twin-wire former. FIG. 4 is a side elevational view illustratively showing a top wire location section of a paper former (on-top former or multilayer former) according to the fourth embodiment of the present invention.

Figure 9:
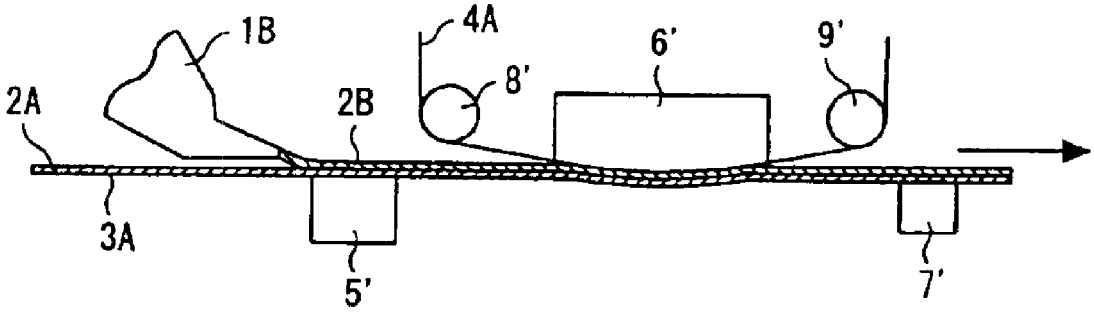
FIG. 9 RELATED ART
FIG. 9 is an illustrative side elevational view showing an essential part of a conventional paper former (twin-wire former).

In this embodiment, a plurality of (in the illustration, two) dewatering blades each similar to the above-mentioned second dewatering blade 31 are provided in series as dewatering blades of a drainage equipment equivalent to the second drainage equipment 6' (see FIG. 9) situated in a top wire location section (section in which a bottom wire 3A and a top wire 4A exist from an upstream portion of the former to a downstream portion thereof) placed for use in, for example, an on-top former or multilayer former.

In this construction, considering the paper production line formed into a nearly parallel configuration, the upstream side dewatering blade 31 and the downstream side dewatering blade 31 are located inversely (upside down) in vertical directions. That is, the upstream side dewatering blade 31 is placed upwardly to come into sliding contact with the bottom wire 3A while the downstream side dewatering blade 31 is placed downwardly to come into sliding contact with the top wire 4A. In this connection, depending upon the paper production line, both the upstream and downstream side dewatering blades 31 and 31 can also be placed in the same direction.

The configurations of the wire sliding contact surfaces 31*b*, 31*b* and grooves 31*a*, 31*a* of the dewatering blades 31, 31 are similar to those of the second dewatering blade 31 according to the first and the second embodiments.

Incidentally, as FIG. 4 shows, another dewatering blade 55 is located on the downstream side of the dewatering blades 31 and 31 of the second drainage equipment 6', and the top wire 4A is guided by guide rolls 56 and 57.

Since the paper former (on-top former or multilayer former) according to the fourth embodiment of the present invention is constructed as described above, as well as the first to third embodiments, the dewatering blades 31 and 31 located in succession display a high drainage ability through the use of a negative pressure drop, thus achieving the improvement of the quality of paper produced.

Although the dewatering blades 21 and 31 according to each of the above-described embodiments are made such that the upstream ends of the grooves 21*a* and 31*a* are formed to be connected almost smoothly and continuously to the wire sliding contact surfaces 21*b* and 31*b* positioned on the upstream side, respectively, as shown in FIG. 5A, it is also appropriate that, as shown in FIG. 5B, a dewatering blade, designated at numeral 121 or 131, is made such that a step 100 is formed between the upstream end of a groove 121*a* or 131*a* and a wire sliding contact surface 121*b* or 131*b* existing on the upstream side. This can further increase the negative pressure effect.

In this case, the increase in the negative pressure effect contributes to the improvement of the drainage ability but, at the same time, rather causes the occurrence of paper defects due to the occurrence of disturbance in the plane (interface with air) of the stock 2, so it is preferable that the size dd of the step 100 is set according to the location and taking these points into consideration.

In addition, although the negative pressure effect lowers only in a foil configuration, it is also applicable to each of dewatering blades 221 and 231 in which grooves 221*a*, 231*a* are made from an upstream end of a wire sliding contact surface 221*b*, 231*b* to a downstream end thereof as shown in FIG. 5C. In particular, although the negative pressure effect decreases when this dewatering blade is applied to only a lead-in blade, it is also possible that a second dewatering blade is made as shown in FIG. 5A or 5B to considerably enhance the drainage performance through the use of the negative pressure effect while being designed to remove the air flow incident to the plane of the material jet 2. In FIGS. 5A, 5B and 5C, numerals 121*c*, 221*c*, 131*c* and 231*c* designate key grooves, respectively.

In this connection, this applicant has already filed applications (Japanese Patent Laid-Open (kokai) Nos. HEI 4-370288 and 5-71091) on an invention about dewatering shoes (dewatering blades) having a configuration similar to that of the dewatering blades 21 and 31 according to this embodiment. Each of these shoes has a surface in which a plurality of grooves are made in parallel with each other in a state inclined with respect to the traveling direction of a stock, as well as the dewatering blades 21 and 31 according to this embodiment. However, these grooves are for producing a material pressure profile difference between portions adjacent to each other in a machine width direction to apply a pressure to fibers of a material in the machine width direction through the use of the difference in the machine width-direction pressure for lowering the degree of orientation of the fibers in the machine direction. Accordingly, these shoes are different in object and function from the dewatering blades 21 and 31 according to this embodiment.

The embodiments of the present invention have been described above, and it should be understood that the present invention is not limited to the above-described embodiments, and that it is intended to cover all changes and modifications of the embodiments of the invention herein which do not constitute departures from the spirit and scope of the invention.

For example, although, in each of the above-described embodiments, the directions of the grooves 21*a* and 31*a* are inclined by the predetermined inclination θ with respect to the moving direction of the stock 2, since the dewatering can also be made by the dewatering blades (see reference numerals 20*c* to 20*e* in FIGS. 5A, 5B and 5C) other than the dewatering blades 21 and 31, the drainage is not always performed equally in the cross direction of the stock 2 by only the dewatering blades 21 and 31. Depending on the quality of paper needed, there is a case in which the drainage conditions on the dewatering blades 21 and 31 do not require the equal drainage in the cross direction of the stock 2. In this case, it is also acceptable that the inclination θ is set to zero.

In addition, although, in the above-described embodiments, one dewatering blade 21 and one dewatering blade 31, two in total, or two dewatering blades 31, are located in succession, it is also possible that three or more dewatering blades are located in succession.

Also in this case, considering that the inclination θ of each of the grooves 21*a* and 31*a* has influence on the mobility of paper fibers in the stock 2, the inclination θ of the grooves of each of the plurality of dewatering blades is set to wholly equalize the mobility of the paper fibers of the stock 2 laterally in the dewatering blades.

Still additionally, in a case in which a plurality of dewatering blades shown in any one of FIGS. 5A, 5B and 5C are located in the wire traveling direction, if all the dewatering blades are set to have the same configuration, it is advantageous in cost. However, the radius of curvature R of each of the loops of the wires 3 and 4 can vary so that the characteristics required for the dewatering blades at the respective positions vary delicately; therefore, it is preferable that a portion of or all of the dewatering blades are made to be different in configuration from each other. In this case, among the geometric parameters, there are a radius of curvature or rate of change of curvature of a wire sliding contact surface, configurations (groove width $W_1$, inter-groove separation $W_2$, inclination θ, angle ξ, step 100, and others) of each of grooves, and others, and it is preferable that a portion of or all of these values are set to optimum values.

What is claimed is:

1. A paper former comprising two wires which converge for defining a paper production gap and a plurality of dewatering blades arranged in said paper production gap in a paper producing direction and brought into sliding contact with one of said two wires so that a stock is dehydrated while being conveyed in a state put in said paper production gap, each of said plurality of dewatering blades being shaped into a convexly curved surface configuration bent along a traveling direction of one of said two wires and equipped with a wire sliding contact surface brought into sliding contact with said wire for guiding the traveling of said wire, and a moisture run-off opening being made in said wire sliding contact surface for running off moisture developing through the dewatering from the wire side;

wherein, said moisture runoff opening in any of said wire sliding contact surfaces comprises a plurality of parallel grooves, and, for two adjacent dewatering blades of said plurality of dewatering blades, a direction of inclination of grooves made in a first wire sliding contact surface with respect to a moving direction of said stock, and a direction of inclination of grooves made in a second wire sliding contact surface with respect to said moving direction of said stock, are set to be different from each other, and are mutually set as line symmetry, wherein a step is formed between an upstream end of a groove formed on a dehydrating blade and the wire sliding contact surface, and wherein said dewatering blades constituting a portion of said plurality of dewatering blades are brought into sliding contact with one of said two wires while the remaining dewatering blades are brought into sliding contact with the other wire.

2. A paper former according to claim 1, wherein said moisture run-off opening of each of said wire sliding contact surfaces of a portion of or all of said plurality of dewatering blades is formed throughout a section from an upstream side intermediate portion of said wire sliding contact surface to a downstream side end thereof except an upstream side end of said wire sliding contact surface.

3. A paper former according to claim 1, wherein said paper production gap is formed from the most upstream side portion of said former to which a stock is injected in a jetted fashion so that said former is constructed as a twin-wire former.

4. A paper former according to claim 3, wherein a former upstream side portion of said wire sliding contact surface of a first dewatering blade of said plurality of dewatering blades, which is located at said former most-upstream portion, has a curved surface configuration inclined to enlarge said paper production gap gradually toward the former upstream side, and a landing point of the jetted stock on said wire is set at a place where said moisture run-off opening exists on said wire sliding contact surface of said first dewatering blade.

5. A paper former according to claim 3, wherein said wire sliding contact surface of a first dewatering blade of said plurality of dewatering blades, which is located at said former most-upstream portion, is formed into a curved surface configuration inclined to enlarge said paper production gap gradually toward the former upstream side, and a landing point of the jetted stock on said wire is set in the vicinity of an upstream end of said wire sliding contact surface of said first dewatering blade.

6. A paper former according to claim 1, wherein said paper production gap is made at an intermediate portion of said former so that said former is constructed as a former with a top wire, including an on-top former and a multilayer former.

7. A paper former according to claim 1, wherein all of said plurality of dewatering blades are brought into sliding contact with one of said two wires.

8. A paper former according to claim 1, wherein a plurality of grooves are made in parallel in each of said wire sliding contact surfaces along a moving direction of said stock in a range from an upstream end side intermediate portion of said wire sliding contact surface to a downstream end portion thereof, except an upstream end portion of said wire sliding contact surface, so that said grooves function as said moisture run-off opening.

9. A paper former according to claim 8, wherein a depth of each of said grooves is made to increase gradually toward said moving direction of said stock.

10. A paper former according to claim 8, wherein a direction of each of said grooves is inclined with respect to said moving direction of said stock.

11. A paper former according to claim 1, wherein directions of inclination of said grooves are set to be angularly axial-symmetrical with each other, with respect to the traveling direction of said one of said two wires.

12. A paper former according to claim 1, wherein directions of inclination of said grooves are set to be angularly symmetrical with each other, with respect to said moving direction of said stock.

* * * * *